United States Patent [19]

Fischer

[11] Patent Number: 4,874,175

[45] Date of Patent: Oct. 17, 1989

[54] LOTTERY DICE

[76] Inventor: Daniel E. Fischer, 2845 N. Kings Rd., Virginia Beach, Va. 23452

[21] Appl. No.: 256,054

[22] Filed: Oct. 11, 1988

[51] Int. Cl.[4] ..... A63F 9/04

[52] U.S. Cl. ..... 273/146

[58] Field of Search ..... 273/146, 147

[56] References Cited

U.S. PATENT DOCUMENTS

| | | | |
|---|---|---|---|
| D. 283,632 | 4/1986 | Moore . | |
| 997,137 | 8/1908 | Perkins | 273/147 |
| 2,739,815 | 9/1952 | Fay . | |
| 4,452,588 | 6/1984 | Smith | 273/146 X |
| 4,497,487 | 2/1985 | Crippen | 273/146 |
| 4,793,619 | 12/1988 | Unander-Scharin | 273/146 |

FOREIGN PATENT DOCUMENTS

| | | | |
|---|---|---|---|
| 3512030 | 8/1985 | Fed. Rep. of Germany | 273/146 |
| 2432327 | 4/1980 | France | 273/146 |

OTHER PUBLICATIONS

"Scarne's New Complete Guide to Gambling" by John Scarne, publ. by Simon & Schuster, N.Y., copyright 1961, p. 312 relied on.

*Primary Examiner*—Anton O. Oechsle

*Attorney, Agent, or Firm*—Raymond L. Greene

[57] ABSTRACT

The invention is a pair of dice, a first die 10 having inclined sides 12 such that the base 14 is larger than the top 15. This novel shape when combined with a selected range of numbers on the faces of die allows a selection of lottery numbers suitable for a variety of number ranges. The first die also have a logo inscribed which has a low probability of occurrence due to the bias caused by the design of the die. A second die has a conventional shape, but also has a unique number range 31 such that by rolling the dice either singularly or in pairs, a full range of lottery numbers may be rolled.

4 Claims, 2 Drawing Sheets

LOTTERY DICE

TECHNICAL FIELD OF THE INVENTION

This invention relates to gaming devices and more particularly to dice suitable for selecting random numbers in lottery games.

BACKGROUND OF THE INVENTION

Increasing popularity of lottery games has created a demand in the market for devices to assist in number selection. These devices serve a variety of functions. They can reduce inadvertent bias introduced by the player, provide random selection from a particular group of numbers, and can incorporate the statistical odds of a particular lottery. Several systems are now on the market ranging from simple roulette-style wheels to complex computer programs.

Various electronic devices, including specially-programmed computers, have been used to select lottery numbers. Electronic systems are well-suited to the task of random number selection and can easily be adapted to any range of numbers. Also, these systems can be biased toward a particular group of numbers. However, electronic systems tend to lack easy portability and often require relatively long set-up times. For convenience and speed of selection, the majority of lottery players using a system depend on the simpler devices, and in particular, on dice.

Because different lotteries typically have different ranges of numbers, each of these number selection systems must be tailored to the individual lottery. Several prior art methods involve the use of modified dice to assist in lottery number selection. For example, a twenty-sided die, used three in a set, was developed for the New York Lottery. In this gaming system, two numbers were inscribed on each of the twenty faces of each die so that a random selection of numbers in the range of 0 to 40 could be made. Although this system is highly effective for the New York Lottery, it cannot be used in other lotteries having different number ranges. The present invention was developed to accommodate the broader requirements of the market for a small, simple and adaptable system which can be taken to a lounge or other public facility and used quickly and easily.

Accordingly, it is an object of the present invention to provide a device suitable without modification for selection of numbers from several specific number ranges.

It is a further object of the present invention to provide a portable pocket gaming device.

It is yet another object of the present invention to provide a simple, convenient system for the selection of lottery numbers which will avoid inadvertent bias by the player.

It is still another object of the present invention to provide a set of dice suitable for lottery number selection.

It is still a further object of the present invention to provide a set of dice in which one die uses only five sides for number selection and is biased such that there are reduced odds of occurrence of the sixth side.

SUMMARY OF THE INVENTION

The invention is a modification of a pair of conventional six-sided dice such that one die selects the numbers 0 through 4 and the other die selects the numbers 0 through 5. The first die is further modified such that the probability of occurrence of one of the sides is reduced Either die may be used to select a digit depending on the range of numbers desired or both dice may be added together to select digits in the range of 0 to 9. By further combinations, various groups of numbers may be selected as a pool from which a random number selection is made

BRIEF DESCRIPTION OF THE DRAWINGS

A more complete appreciation of the present invention and the features attendant thereto will become apparent as the same becomes better understood by reference to the following descriptions when considered in connection with the accompanying drawings wherein.

DETAILED DESCRIPTION OF THE INVENTION

Figure 1:
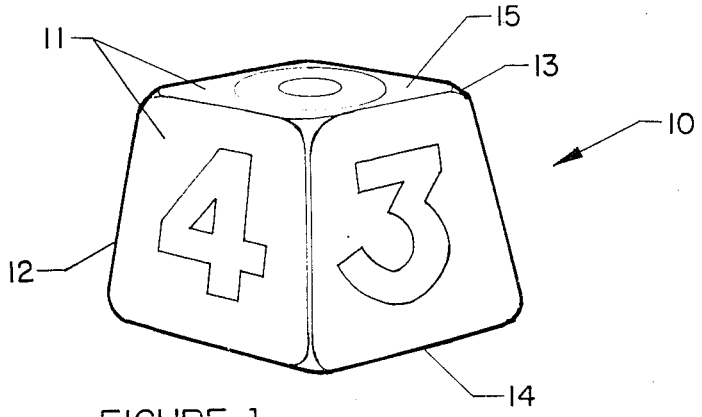
FIG 1 is a perspective view of a first die of the present invention designed for a digit range of 0 to 4.

Referring now to FIG. 1, a perspective view of a first die of the present invention, designated generally by the numeral 10, shows both the range of numbers assigned to the sides of the die and the construction details The range of numbers 11 for this dies is zero to four. The purpose of this particular range is to permit a player to use this die to select a first digit for a lottery number between zero and forty-nine. Rolling this die selects the "tens" value and rolling the pair, more fully described below, selects the second digit or units value The base 14 of the die is inscribed with a symbol or logo. During dice rolls, the occurrence of this logo is infrequent due to the shape of the die.

Figure 2:
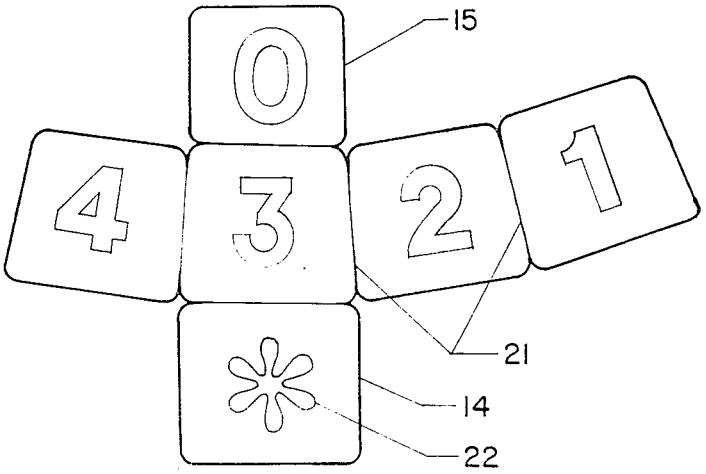
FIG. 2 is pattern of the first die showing construction angles and surface areas.

The shape of the first die is characterized by an inclination of the sides 12 at a small angle from true vertical and a rounding of the corners 13. In the preferred embodiment the size of the base 14 is a seven-eights inch ($\frac{7}{8}''$) square. The top 15 is a three-quarter inch ($\frac{3}{4}''$) square. This size difference provides an angling in of the sides by 1/16 inch from true vertical Although the angle is small and the linear dimension of the top is reduced by only one-eight inch, the difference is surface area is significant. The top has a surface area of $\frac{3}{4}''\times\frac{3}{4}''=0.56$ square inch while the base is $\frac{7}{8}''\times\frac{7}{8}''=0.77$ square inch. The base has 36 percent more surface area than the top of the die. As a result of the surface area differences, the die 10 is biased so that a roll is more likely to yield one of the numbers than the logo. Further, the narrowing of the die towards the top results in a slightly lowered center-of-gravity further biasing the die to reduce the probability of the symbol or logo appearing. The net effect is that the logo appears approximately one-third as often as the other sides or top appear The logo appears approximately five times in ninety rolls. The probability of occurrence of the top or sides of the die is the same due to a slight increase in height of the sides of the die. The probability of occurrence of a top or side is approximately seventeen times in ninety rolls Referring now to FIG. 2, a pattern is depicted showing the arrangement of the range of numbers on the sides with the zero on top 15. The larger size of base 14 is shown in scale along with the smaller top. The slight inclination of the sides can be seen at the pattern fold lines 21. The stylized logo 22 appears on base 14.

Figure 3:
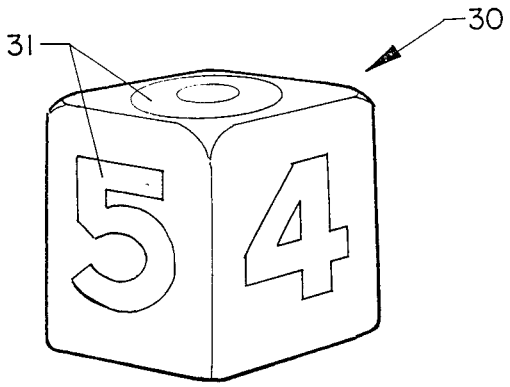
FIG. 3 is a perspective view of a second die of the present invention designed for a digit range of 0 to 5.

Referring now to FIG. 3, a perspective view of a second die 30 of the present invention is shown being shaped in a conventional cube form, but having a number range 31 from zero to five inclusive. The set of dice of the present invention are rolled twice to select numbers in a lottery from zero to forty-nine. The first die is rolled first to select the tens digit; then both dice are rolled and the sum of the dice selects the second or units digit. Other combinations will allow a selection of numbers from other ranges For example, if both dice are rolled twice, then the number will be selected from zero to ninety-nine by summing the dice on each roll to form the first and second digit. Alternately, by using a single roll of both dice and using the first die as the first digit and the sum of the dice for the second digit, numbers will be selected from five segments of five: zero to five, eleven to sixteen, twenty-two to twenty-seven, thirty-three to thirty-eight and forty-four to forty-nine. In a similar fashion a large variety of number ranges or segments can be selected by altering the number of rolls or by adding or subtracting the dice.

Figure 4:
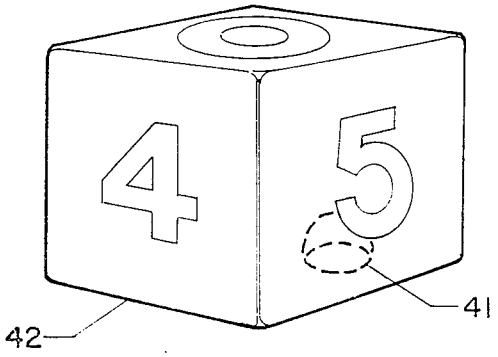
FIG. 4 is a perspective view of an alternate embodiment of the present invention showing a conventional cube-shaped die using an offset weight to alter the center-of-gravity.

Referring to FIG. 4, an alternate embodiment of the first die of the present invention is shown having a conventional cubic form but retaining the biasing feature by using an offset center-of-gravity by adding an internal weight 41 to the die. By weighting the base 42, this die will also be biased so that the base, or logo, will be less likely to be rolled to the up position.

Lottery Gaming with the dice of the present invention for the zero to forty-nine range results in the occurrence of the logo once every nine selections. The occurrence of this symbol is an ill-omen and indicates that no wager should be placed for the lottery chance.

Although the invention has been described relative to a specific embodiment thereof, there are numerous variations and modifications that will be readily apparent to those skilled in the art in the light of the above teachings. As an example, the numerals on the dice could easily be replaced by dots. It is therefore to be understood that, within the scope of the appended claims, the invention may be practiced other than as specifically described.

What is claimed is:

1. A gaming device suitable for selecting random numbers for lottery games comprising:

a hexahedral die having faces valued from zero to four and a base surface inscribed with a symbol;

means for biasing said hexahedral die such that there is a reduced probability for the appearance of the symbol on the uppermost surface of the die when the die is thrown, said biasing means comprising the inward slanting of the sides of the die so as to reduce the surface area of the face opposite said base to approximately two-thirds of the surface area of the base; and a second die keyed to a second range of numbers.

2. A gaming device as in claim 1 wherein said hexahedral die has the height of the inwardly slanting sides greater than the length of the base such that the surface area of each of the slanting sides approximates the surface area of the base.

3. A gaming device as in claim 1 wherein said second die has top, base and side faces valued from zero to 5.

4. A method of selecting lottery numbers in a range of zero to forty-nine comprising the steps of:

rolling a first modified die to select a number from the range zero to four as a first digit of a lottery number;

rolling said first modified die and a second die to select additional numbers from the range zero to four and zero to five respectively; and summing said additional numbers to provide a second digit of a lottery number.

* * * * *